US005327112A

United States Patent [19]

Rossetti

[11] Patent Number: 5,327,112

[45] Date of Patent: Jul. 5, 1994

[54] ELECTROMAGNETIC ACTUATOR OF THE TYPE OF A RELAY

[75] Inventor: Gianpaolo Rossetti, Cremona, Italy

[73] Assignee: Bticino S.p.A., Italy

[21] Appl. No.: 635,190

[22] PCT Filed: Jul. 7, 1989

[86] PCT No.: PCT/EP89/00784

§ 371 Date: Mar. 4, 1991

§ 102(e) Date: Mar. 4, 1991

[87] PCT Pub. No.: WO90/00807

PCT Pub. Date: Jan. 25, 1990

[30] Foreign Application Priority Data

Jul. 8, 1988 [IT] Italy ..... 21296 A/88

[51] Int. Cl.[5] ..... H01H 51/22

[52] U.S. Cl. ..... 335/78; 335/230; 335/18

[58] Field of Search ..... 335/78-86, 335/128, 18, 229, 234, 236, 304, 230

[56] References Cited

U.S. PATENT DOCUMENTS 3,914,723 10/1975 Goodbar ..... 335/78
4,385,280 5/1983 Reisem ..... 335/230
5,010,310 4/1991 Frielinghaus ..... 335/243

*Primary Examiner*—Lincoln Donovan
*Attorney, Agent, or Firm*—Leydig, Voit & Mayer, Ltd.

[57] ABSTRACT

An electromagnetic actuator (1) of the type of a relay, having an armature (2) polarized by a permanent magnet (5) and a movable drive element (6) attracted by the armature (2) against a spring means (8), incorporates an electric current sensor consisting of a toroidal transformer (16) penetrated by at least one conductor (17) from an electric power supply line. The actuator (1) of this invention has a major advantage in that it can combine in a single device the functions of sensing differential currents on the line and of tripping off the break mechanism of a protection breaker, within a highly compact volume.

7 Claims, 1 Drawing Sheet

ELECTROMAGNETIC ACTUATOR OF THE TYPE OF A RELAY

TECHNICAL FIELD

This invention relates to an electromagnetic actuator of the type of a relay having a yoke polarized by a permanent magnet and a movable armature which is attracted by said yoke against a spring means, said actuator being controlled by an electric current sensor comprising a toroidal transformer wherethrough at least one electric conductor is passed.

The field of application of this invention is particularly, but not exclusively, related to electric guarding apparatus from differential currents, and reference will be made throughout the following description to just that field of application for convenience of illustration.

BACKGROUND ART

Known are, in this specific field of application, protection apparatus which are intended for installation at consumer's outlets of single-phase or three-phase power supplies of the civil or industrial kinds.

Such prior apparatus include a protective automatic breaker, usually of the magnetothermic type, whose break mechanism is driven by a solenoid.

Also provided is a differential current sensor which comprises a toroidal transformer encircling the power supply line and being adapted to warn of the appearance of such currents, also referred to as leakage currents, by sensing any unbalance in the currents flowing through the line conductors.

The sensor is connected to the solenoid coil so as to trip off the breaker mechanism on a predetermined differential current value being exceeded.

High performance (type "A") protection apparatus, such as those designed to become operative on unidirectional or pulsed currents being sensed, include an electronic circuit connected between the sensor and the solenoid. This circuit is generally made up of series and/or cascade connected capacitors.

While being in many ways advantageous and substantially up to their intended function, such apparatus still have several drawbacks, as pointed out herein below.

The current-detection and break mechanism trip-off steps involve a sequel of energy conversions from electric into electromagnetic, and vice versa, and ultimately into mechanical, which unavoidably brings about losses and restricts the apparatus response.

The provision of an electronic circuit including capacitors is both cost-, space-, and power-intensive.

The solenoid and the toroidal transformer which forms the current sensor, by their very presence restrict the possibility of making such protection apparatus more compact.

Patent Application GB-A-2074380 discloses an electromagnetic breaker having a yoke polarized by a permanent magnet and a movable element which is attracted by the yoke against spring; electric conductors are passed through a hole in the yoke so that the magnetic flux induced by conductors through the yoke interferes with the permanent magnetic flux from the permanent magnet.

The technical problem that underlies this invention is to provide an electromagnetic actuator of the type of a relay, which has such structural and performance characteristics as to overcome the above-noted drawbacks.

DISCLOSURE OF INVENTION

The solutive idea on which this invention is based is to provide an electromagnetic actuator which also combines the structure and function of the differential current sensor.

The technical problem is solved by an actuator as indicated being characterized in that said transformer is incorporated to the actuator such that the magnetic flux induced therethrough by the conductor will interfere with the permanent magnetic flux from said magnet.

The features and advantages of an actuator according to the invention will be apparent from the following detailed description of an embodiment thereof, given by way of illustration and not of limitation with reference to the accompanying drawing.

BEST MODE FOR CARRYING OUT THE INVENTION

Figure 1:
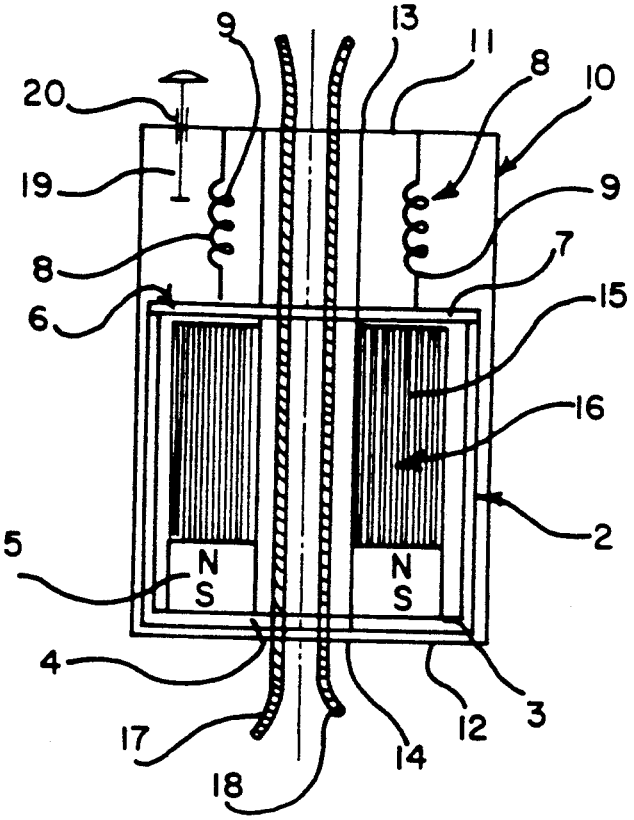
FIG. 1 shows, in elevation and in section, the electromagnetic actuator of this invention.
Figure 2:
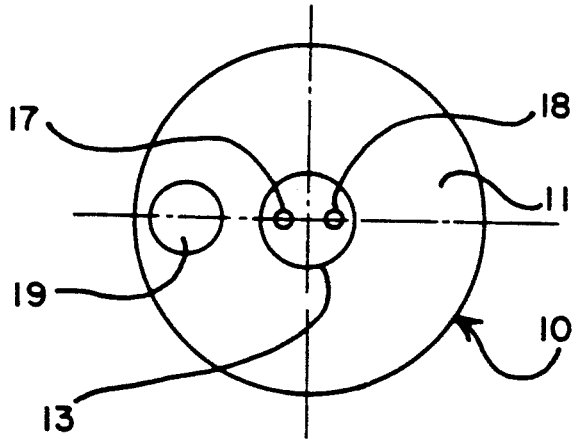
FIG. 2 is a view from above of the actuator shown in FIG. 1.

With reference to the drawing views, shown generally and schematically at 1 is an electromagnetic actuator embodying this invention. The actuator 1 is basically of the type of a relay and particularly, though not exclusively, operative to trip off the break mechanism of an electric protection breaker associated with an apparatus for protection from differential currents, not shown because known per se.

This actuator 1 comprises a yoke 2 made of a ferromagnetic material and housed within a cylindrical protective case 10 which has opposed bases 11 and 12 formed with corresponding coaxial center holes 13 and 14.

The yoke 2 is substantially in the form of a cylindrical bowl having a bottom 3 provided centrally with a through hole 4 coaxial with the above-mentioned holes 13 and 14.

The yoke 2 is polarized by an annular permanent magnet 5 resting on the yoke bottom 3 coaxially with the hole 4.

The actuator 1 further comprises a movable armature 6 consisting of an annular metal plate 7 which is attracted by the yoke 2 against the bias force of a spring means 8. The yoke 2 and movable armature 6 form respectively fixed and moving portions of a magnetic circuit.

The means 8 is comprised of adjustable force springs which connect the plate 7 to the wall 11 of the case 10 on the case interior.

The diameter of the plate 7 is equal to the outside diameter of the yoke 2, and the plate is formed from a ferromagnetic having the same permeability as that of the yoke 2.

Advantageously, a core 15 of a toroidal transformer 16 fits inside the yoke 2 between the magnet 5 and the movable armature 6. The core 15 consists of a coiled foil having a high magnetic permeability.

The actuator 1 is penetrated by conductors 17 and 18 led through the holes 13 and 14 in the case 10, the hole 4 in the yoke 2, and through the annuli of the armature 6, core 15, and magnet 5. The conductors 17 and 18 may be the phase wire and neutral wire of a single-phase electric power supply line, or the phase wires of a multiphase supply line.

The transformer 16 is an electric current sensor, specifically for sensing so-called leakage differential currents, and in this respect, a primary winding is wound around it which is formed of two or three turns of the conductor wire 17, for example.

The actuator 1 structure is completed by a push driver 19 which extends through a hole 20 provided off-centrally in the wall 11 of the case 10. The stroke path of the movable armature 6 will interfere with that pusher 19 which constitutes the drive element for the actuator 1.

Figure 3:
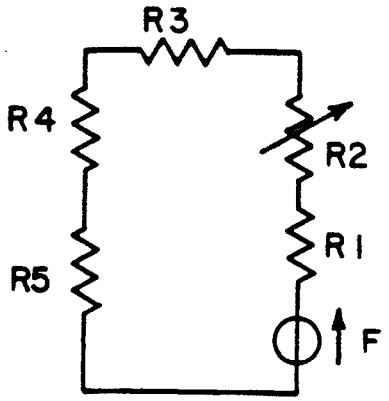
FIG. 3 is a view showing in diagramatic form an equivalent electromagnetic circuit of the actuator of FIG. 1.

Now, with specific reference to the example shown in FIG. 3, there is depicted an equivalent electric circuit of the electromagnetic actuator according to the invention, or rather, just a portion thereof, symmetrical about its centerline.

Indicated at F is an equivalent voltage source of the magnetomotive force developed by the permanent magnet 5. Indicated at R1 is an equivalent resistance of the internal reluctance of the permanent magnet 5.

The reference R2 designates a variable resistance relatively to the internal reluctance of the toroidal core 15 due to plural parallel reluctances corresponding with the rings which make up that core.

At R3 and R5, there are indicated resistances relating to the reluctances of the fixed and moving magnetic circuit portions provided by the yoke 2 and the armature 6, respectively.

Lastly, indicated at R4 is the equivalent resistance of the reluctance in air of the contact parts between the yoke 2 and the movable armature 6. This may be regarded to be the sum of the reluctance in air related to the contact of the moving portion with the fixed portion plus the saturation control reluctance.

The operation of the actuator according to this invention will be next described.

Where no differential currents appear between the conductors 17 and 18, the actuator 1 will behave as an ordinary relay. The permanent magnet 5 generates the required magnetic flux to hold the armature 6 in contact with the yoke 2.

The magnetic flux from the magnet 5 will cross the toroidal coiled foil core 15 which assists in holding the movable armature 6 in contact with the yoke 2 by a predetermined attractive force and against the elastic bias force from the springs 9.

Should any shape differential current flow through the wire 17 winding, the magnetic field induced by this current will mainly concentrate within the high-permeability toroidal core 15. The direction of this magnetic field is orthogonal to and interferes with that of the flux from the permanent magnet 5.

By suitably dimensioning the materials which make up the actuator 1, it may be arranged that the toroidal core 15 is brought to saturation, or close to it, by the flux induced by the differential current and the permanent magnetic flux overlapping each other.

In such a circumstance, the reluctance of the toroidal core 15 is greatly increased, and increased is therefore the value of the variable reluctance R2. Thus, a limitation is imposed on the flux from the permanent magnet 5 which, in turn, crosses the core 15.

In fact, that flux is diverted toward the metal skirt of the yoke 2, thus weakening the attractive force to the armature 6, thereby the latter, as a result of the elastic bias applied thereto by the spring means 8, will trip off the break mechanism of the protection breaker through the pusher 19.

INDUSTRIAL APPLICABILITY

Thus, the actuator of this invention affords a major advantage in that it combines in a single device the sensing and driving function and greatly reduced space requirements.

This actuator is also operative on sensing unidirectional differential currents, irrespective of their waveforms, on the order of a few milliamperes.

It stands to reason that the invention may be embodied in a number of different ways as may fall within the spirit of the solutive idea described hereinabove and be afforded the same protection.

I claim:

1. An electromagnetic actuator (1) of the type of a relay having a yoke (2) polarized by an annular permanent magnet (5) and an annular movable armature (6) which is attracted by the yoke (2) against a spring means (8), the actuator being controlled by an electrical current sensor comprising a transformer (16) having a toroidal core (15) wherethrough at least one electric conductor (17) is passed, the toroidal core (15) being fitted coaxially between the annular permanent magnet (5) and the annular movable armature (6), the transformer (16) being incorporated into the actuator (1) such that the toroidal core is crossed by a first magnetic flux from the permanent magnet, a second magnetic flux induced in the toroidal core by current flowing in the conductor (17) interfering orthogonally with the first magnetic flux from the permanent magnet (5).

2. An actuator according to claim 1, wherein the core (15) is a high permeability core.

3. An actuator according to claim 1, wherein the yoke (2) has a substantially bowl-like shape with a bottom (3) formed centrally with a hole (4), the magnet (5) being arranged to rest on the bottom (3).

4. An actuator according to claim 1, wherein the conductor wire (17) is wound around the core (15) to provide at least one turn of a primary winding.

5. An actuator according to claim 1, further comprising a protective case (10) and springs (9) interconnecting the movable element (6) and the case (10) and forming the spring means (8).

6. An actuator according to claim 7, wherein the case (10) is cylindrical and comprises opposed bases (11,12) formed centrally with corresponding holes (13,14) coaxial with the toroidal core (15).

7. An actuator according to claim 1, intended for tripping off the break mechanism of a protection breaker under control by a sensor of differential currents in an electric power supply line, wherein the transformer (16) is provided with a primary winding formed by at least one wire (17) of the supply line and operative, in the presence of a differential current, to induce within the core (15) a magnetic field flux interfering with the permanent magnetic flux from the magnet (5).

* * * * *